US010470954B2

(12) United States Patent
Cox et al.

(10) Patent No.: US 10,470,954 B2
(45) Date of Patent: Nov. 12, 2019

(54) PATIENT SUPPORT APPARATUS WITH DECK SECTION LINK

(71) Applicant: Stryker Corporation, Kalamazoo, MI (US)

(72) Inventors: Robert Gregory Cox, Kalamazoo, MI (US); Krista Lynn Fox, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 317 days.

(21) Appl. No.: 15/634,252

(22) Filed: Jun. 27, 2017

(65) Prior Publication Data

US 2017/0367913 A1 Dec. 28, 2017

Related U.S. Application Data

(60) Provisional application No. 62/355,513, filed on Jun. 28, 2016.

(51) Int. Cl.
*A61G 7/015* (2006.01)
*A61G 7/018* (2006.01)
(Continued)

(52) U.S. Cl.
CPC ..... *A61G 7/015* (2013.01); *A61G 7/012* (2013.01); *A61G 7/018* (2013.01); *A61G 7/0513* (2016.11);
(Continued)

(58) Field of Classification Search
CPC ..... A61G 7/002; A61G 7/005; A61G 7/012; A61G 7/015; A61G 7/018; A61G 13/02; A61G 13/04; A61G 13/06; A61G 13/08
(Continued)

(56) References Cited

U.S. PATENT DOCUMENTS 219,264 A 9/1879 Howe et al.
1,701,588 A * 2/1929 Muller ..... A61G 7/015 5/618
(Continued)

FOREIGN PATENT DOCUMENTS

DE 4310443 A1 4/1994
DE 19901127 C2 4/2003
(Continued)

OTHER PUBLICATIONS

English language abstract and machine-assisted translation for DE19901127 extracted from espacenet.com on Feb. 14, 2018; 9 pages.
(Continued)

*Primary Examiner* — Robert G Santos
(74) *Attorney, Agent, or Firm* — Howard & Howard Attorneys PLLC

(57) ABSTRACT

A patient support apparatus comprising a support frame and a patient support deck operatively attached to the support frame. The patient support deck has at least one deck section arranged for movement relative to the support frame. An actuator is arranged to move the deck section between an initial configuration and one or more raised configurations relative to the support frame. A link supports the deck section for movement with respect to the support frame. The link has a first end pivotally attached to the support frame, a second end pivotally attached to the deck section, and a protruding stop formed between the first end and the second end arranged to abut the deck section so as to prevent the actuator from moving the deck section beyond a maximum raised configuration.

22 Claims, 16 Drawing Sheets

(51) Int. Cl.
*A61G 7/012* (2006.01)
*A61G 13/08* (2006.01)
*A61G 13/06* (2006.01)
*A61G 7/05* (2006.01)

(52) U.S. Cl.
CPC ..... *A61G 7/0516* (2016.11); *A61G 7/0524* (2016.11); *A61G 7/0514* (2016.11); *A61G 13/06* (2013.01); *A61G 13/08* (2013.01)

(58) Field of Classification Search
USPC ..... 5/618, 600, 610, 611, 613, 616, 617, 5/81.1 R, 86.1
See application file for complete search history.

(56) References Cited

U.S. PATENT DOCUMENTS 2,779,951 A 2/1957 Travis et al.
3,300,794 A 1/1967 Altorfer
3,506,989 A 4/1970 Ross et al.
4,376,316 A * 3/1983 Mercier ..... A47C 20/041 5/57.1
4,385,410 A * 5/1983 Elliott ..... A61G 7/002 5/616
4,862,529 A 9/1989 Peck
5,245,718 A 9/1993 Krauska
5,329,657 A 7/1994 Bartley et al.
5,469,591 A 11/1995 Nomura
5,577,279 A * 11/1996 Foster ..... A61G 7/00 5/602
5,708,997 A * 1/1998 Foster ..... A61G 7/00 5/613
5,933,888 A * 8/1999 Foster ..... A61G 7/05784 5/600
6,112,345 A * 9/2000 Foster ..... A61G 7/05784 5/503.1
6,276,011 B1 * 8/2001 Antinori ..... A47C 20/041 5/613
6,374,436 B1 * 4/2002 Foster ..... A61G 7/0015 5/624
6,516,480 B2 * 2/2003 Elliott ..... A47C 20/041 5/613
6,694,548 B2 * 2/2004 Foster ..... A61G 7/0015 135/67
6,701,553 B1 3/2004 Hand et al.
6,725,474 B2 * 4/2004 Foster ..... A61G 7/0015 5/604
7,895,689 B2 3/2011 Hayes et al.
7,913,336 B2 * 3/2011 Morin ..... A61G 7/015 5/613
9,198,521 B2 12/2015 Robertson
2002/0053109 A1 * 5/2002 Elliott ..... A47C 20/041 5/618
2002/0116760 A1 * 8/2002 Foster ..... A61G 7/0015 5/81.1 R
2003/0019036 A1 * 1/2003 Foster ..... A61G 7/0015 5/430
2009/0044339 A1 * 2/2009 Morin ..... A61G 7/015 5/617
2017/0367913 A1 * 12/2017 Cox ..... A61G 7/015

FOREIGN PATENT DOCUMENTS

JP H9206333 A 8/1997
WO 2010145962 A1 12/2010

OTHER PUBLICATIONS

English language abstract and machine-assisted translation for JPH9206333 extracted from espacenet.com on Feb. 14, 2018; 6 pages.
Hospital bed having back section with 4-bar linkage, available as early as Jun. 28, 2016.
English language abstract and machine-assisted translation for DE4310443 extracted from espacenet.com on Feb. 19, 2018; 6 pages.

* cited by examiner

PATIENT SUPPORT APPARATUS WITH DECK SECTION LINK

CROSS-REFERENCE TO RELATED APPLICATION

The subject patent application claims priority to and all the benefits of U.S. Provisional Patent Application Ser. No. 62/355,513 which was filed on Jun. 28, 2016, the disclosure of which is hereby incorporated by reference.

BACKGROUND

Patient support apparatuses, such as hospital beds, stretchers, cots, tables, and wheelchairs, facilitate care of patients in a health care setting. Conventional patient support apparatuses comprise a base, a support frame upon which the patient is supported, a lift assembly for lifting and lowering the support frame relative to the base, a patient support deck operatively attached to the support frame, and actuators arranged to move sections of the patient support deck relative to the support frame.

It is sometimes desirable for the actuators to move the sections of the patient support deck to a predetermined maximum raised configuration to promote enhanced patient comfort. However, conventional actuators used in connection with patient support apparatuses are often capable of moving the patient support deck to positions beyond the maximum raised configuration. In order to prevent movement beyond the maximum raised configuration, and possibly harm to patients, conventional patient support apparatuses often require the use of actuators with integrated mechanical stops and/or electronic sensors, such as limit switches. However, actuators with integrated mechanical stops may be difficult to adapt for different types of patient support apparatuses, thus necessitating the use of different actuators for different applications. Moreover, electronic sensors may be relatively expensive to implement into patient support apparatuses, and often fail or require adjustment after prolonged use.

While patient support apparatuses have generally performed well for their intended purpose, there remains a need in the art for a patient support apparatus which overcome the disadvantages in the prior art.

DETAILED DESCRIPTION

Figure 1:
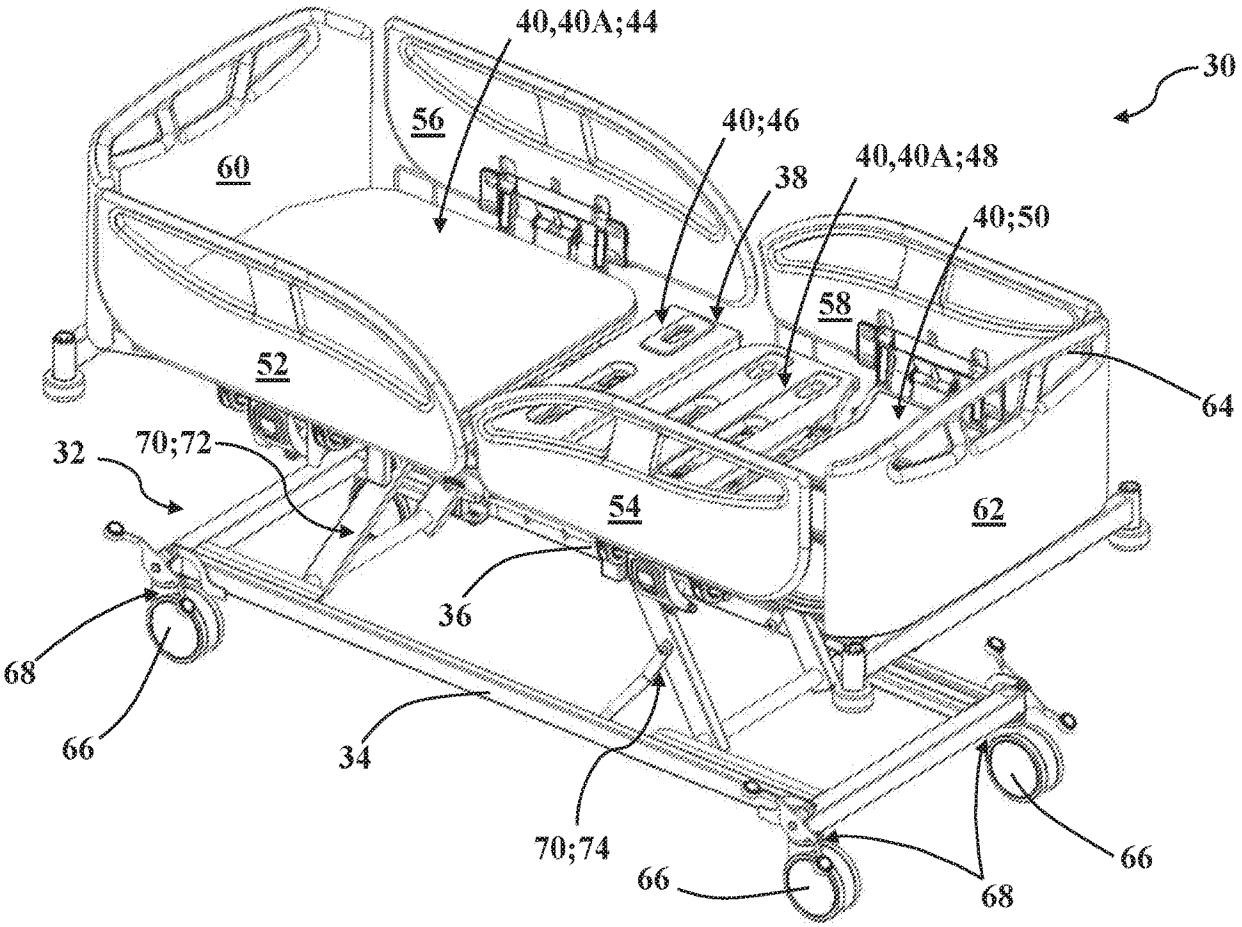
FIG. 1 is a perspective view of a patient support apparatus according to one embodiment.

Referring to FIG. 1, a patient support apparatus 30 is shown for supporting a patient in a health care setting. The patient support apparatus 30 illustrated in FIG. 1 is realized as a hospital bed. In other embodiments, however, the patient support apparatus 30 may be a stretcher, cot, table, wheelchair, or similar apparatus utilized in the care of a patient.

A support structure 32 provides support for the patient. The support structure 32 illustrated in FIG. 1 comprises a base 34 and a support frame 36. The support frame 36 is spaced above the base 34 in FIG. 1. The support structure 32 also comprises a patient support deck 38 operatively attached to the support frame 36. As is described in greater detail below, the patient support deck 38 has at least one deck section 40 arranged for movement relative to the support frame 36. The deck section 40 of the patient support deck 38 provides a patient support surface 42 upon which the patient is supported. More specifically, in the representative embodiment of the patient support apparatus 30 illustrated herein, the patient support deck 38 has four deck sections 40 which cooperate to define the patient support surface 42: a back section 44, a seat section 46, a leg section 48, and a foot section 50 (see FIG. 2). Here, the seat section 46 is fixed to the support frame 36 and is not arranged for movement relative thereto. Conversely, the back section 44 and the leg section 48 are arranged for independent movement relative to each other and to the support frame 36, and the foot section 50 is arranged to move partially concurrently with the leg section 48, as is described in greater detail below.

A mattress (not shown) is disposed on the patient support deck 38 during use. The mattress comprises a secondary patient support surface upon which the patient is supported. The base 34, support frame 36, and patient support deck 38 each have a head end and a foot end corresponding to designated placement of the patient's head and feet on the patient support apparatus 30. The construction of the support structure 32 may take on any known or conventional design, and is not limited to that specifically set forth above. In addition, the mattress may be omitted in certain embodiments, such that the patient rests directly on the patient support surface 42.

Side rails 52, 54, 56, 58 are coupled to the support frame 36 and thereby supported by the base 34. A first side rail 52 is positioned at a right head end of the support frame 36. A second side rail 54 is positioned at a right foot end of the support frame 36. A third side rail 56 is positioned at a left head end of the support frame 36. A fourth side rail 58 is positioned at a left foot end of the support frame 36. If the patient support apparatus 30 is a stretcher or a cot, there may be fewer side rails. The side rails 52, 54, 56, 58 are movable between a raised position in which they block ingress and egress into and out of the patient support apparatus 30, one or more intermediate positions, and a lowered position in which they are not an obstacle to such ingress and egress. It will be appreciated that the patient support apparatus 30 may employ a different number of side rails, such as with a stretcher or a cot equipped with fewer side rails. Moreover, it will be appreciated that in certain configurations, the patient support apparatus 30 may not include any side rails.

As shown in FIG. 1, a headboard 60 and a footboard 62 are coupled to the support frame 36. However, it will be appreciated that the headboard 60 and/or footboard 62 may be coupled to other locations on the patient support apparatus 30, such as the base 34, or may be omitted in certain embodiments.

One or more caregiver interfaces 64, such as handles, are shown integrated into the footboard 62 and the side rails 52, 54, 56, 58 to facilitate movement of the patient support apparatus 30 over floor surfaces. Additional caregiver interfaces 64 may be integrated into the headboard 60 and/or other components of the patient support apparatus 30. The caregiver interfaces 64 are graspable by the caregiver to manipulate the patient support apparatus 30 for movement. It will be appreciated that the caregiver interfaces 64 could be integrated with or operatively attached to any suitable portion of the patient support apparatus 30, or may be omitted in certain embodiments.

Wheels 66 are coupled to the base 34 to facilitate transport over the floor surfaces. The wheels 66 are arranged in each of four quadrants of the base 34 adjacent to corners of the base 34. In the embodiment shown, the wheels 66 are caster wheels able to rotate and swivel relative to the support structure 32 during transport. Each of the wheels 66 forms part of a caster assembly 68. Each caster assembly 68 is mounted to the base 34. It should be understood that various configurations of the caster assemblies 68 are contemplated. In addition, in some embodiments, the wheels 66 are not caster wheels and may be non-steerable, steerable, non-powered, powered, or combinations thereof. Additional wheels are also contemplated. For example, the patient support apparatus 30 may comprise four non-powered, non-steerable wheels, along with one or more powered wheels. In some cases, the patient support apparatus 30 may not include any wheels. In other embodiments, one or more auxiliary wheels (powered or non-powered), which are movable between stowed positions and deployed positions, may be coupled to the support structure 32. In some cases, when these auxiliary wheels are located between caster assemblies 68 and contact the floor surface in the deployed position, they cause two of the caster assemblies 68 to be lifted off the floor surface thereby shortening a wheel base of the patient support apparatus 30. A fifth wheel may also be arranged substantially in a center of the base 34.

Figure 2:
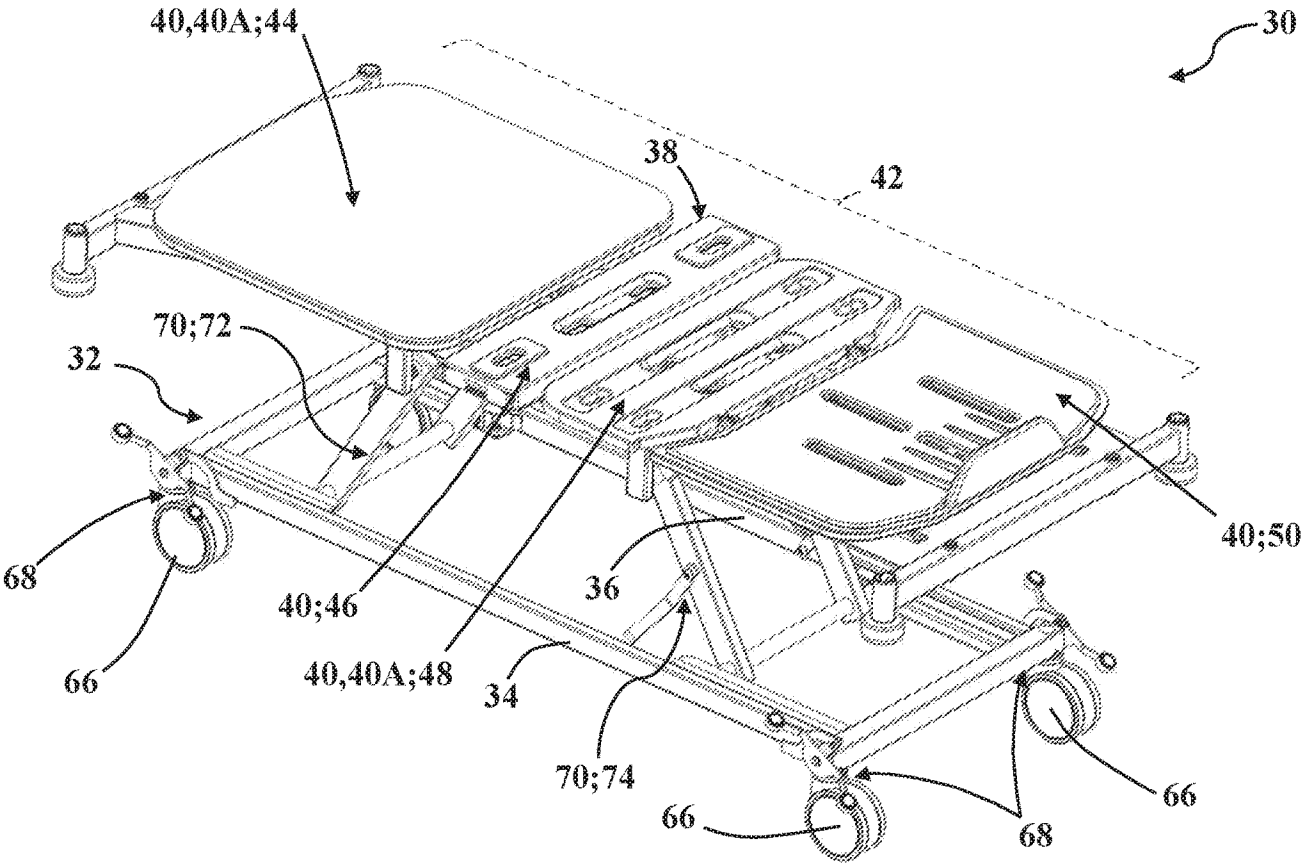
FIG. 2 is a perspective view of a portion of the patient support apparatus of FIG. 1, showing a base, a lift system, a support frame, and a patient support deck.

Referring now to FIGS. 1 and 2, the patient support apparatus 30 further comprises a lift assembly, generally indicated at 70, which operates to lift and lower the support frame 36 relative to the base 34. The lift assembly 70 is configured to move the support frame 36 from a minimum height to a maximum height, or to any desired position in between. To that end, the lift assembly 70 comprises a head end lift member 72 and a foot end lift member 74 which are arranged to facilitate movement of the support frame 36 with respect to the base 34 using one or more lift actuators (not shown). The lift actuators may be realized as linear actuators, rotary actuators, or other types of actuators, and may be electrically operated and/or may be hydraulic. It is contemplated that, in some embodiments, only one lift member and one associated actuator may be employed, e.g., to raise only one end of the support frame 36. The construction of the lift assembly 70, the head end lift member 72, and/or the foot end lift member 74 may take on any known or conventional design, and is not limited to that specifically illustrated.

Referring now to FIGS. 3-8, the patient support deck 38 is operatively attached to the support frame 36 and the deck section 40 is arranged for movement relative to the support frame 36, as noted above. To that end, an actuator 76 (see FIG. 3) is arranged to move the deck section 40 between an initial configuration 40A (see FIG. 4), a maximum raised configuration 40B (see FIG. 6), and one or more raised configurations 40C between the initial configuration 40A and the maximum raised configuration 40B (see FIG. 5). A link, generally indicated at 78, interconnects the deck section 40 and the support frame 36 to enable movement of the deck section 40 with respect to the support frame 36. The link 78 has a first end 80 pivotally attached to the support frame, a second end 82 pivotally attached to the deck section 40, and a protruding stop 84 formed between the first end 80 and the second end 82 (see FIG. 3). The protruding stop 84 is arranged to abut the deck section 40 so as to prevent the actuator 76 from moving the deck section 40 beyond the maximum raised configuration 40B. The deck section 40, the actuator 76, and the link 78 will each be described in greater detail below.

Figure 3:
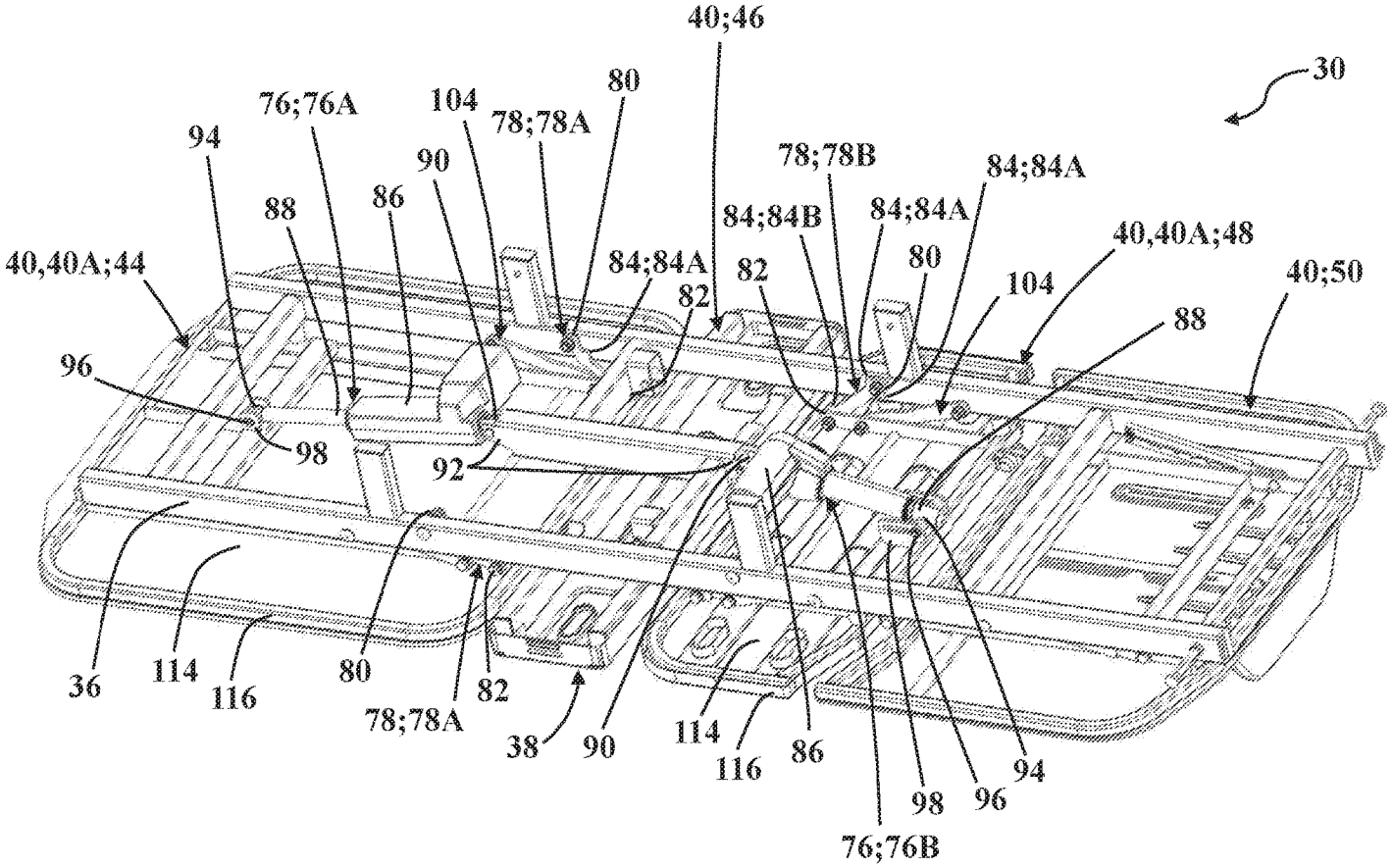
FIG. 3 is a rotated perspective view of the support frame and the patient support deck of the patient support apparatus of FIG. 2, showing actuators arranged to move respective deck sections supported by links with respect to the support frame.
Figure 4:
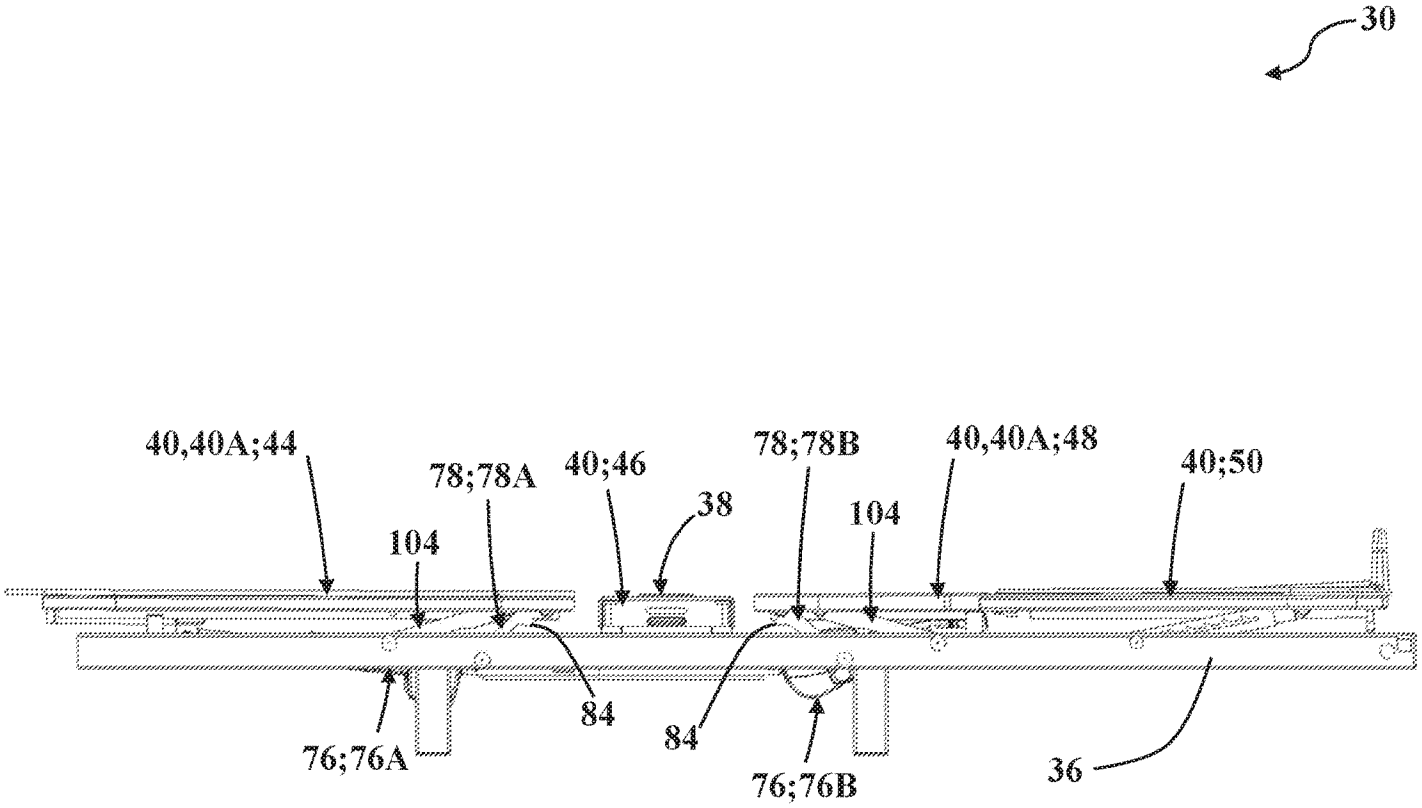
FIG. 4 is a side view of the support frame and the patient support deck of FIG. 3, showing a head deck section and a leg deck section each in an initial configuration.
Figure 5:
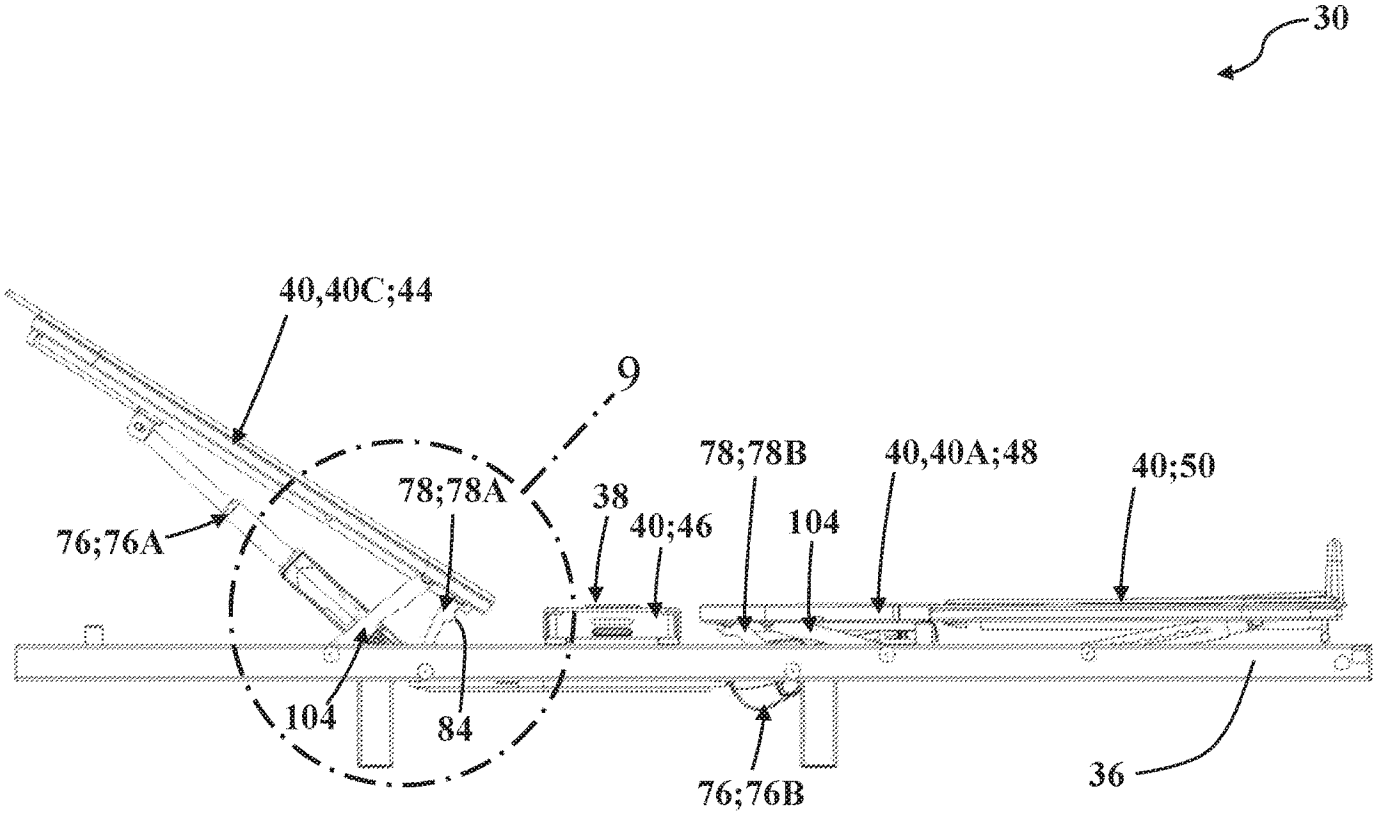
FIG. 5 is another side view of the support frame and the patient support deck of FIG. 4, showing the head deck section in a first raised configuration.
Figure 6:
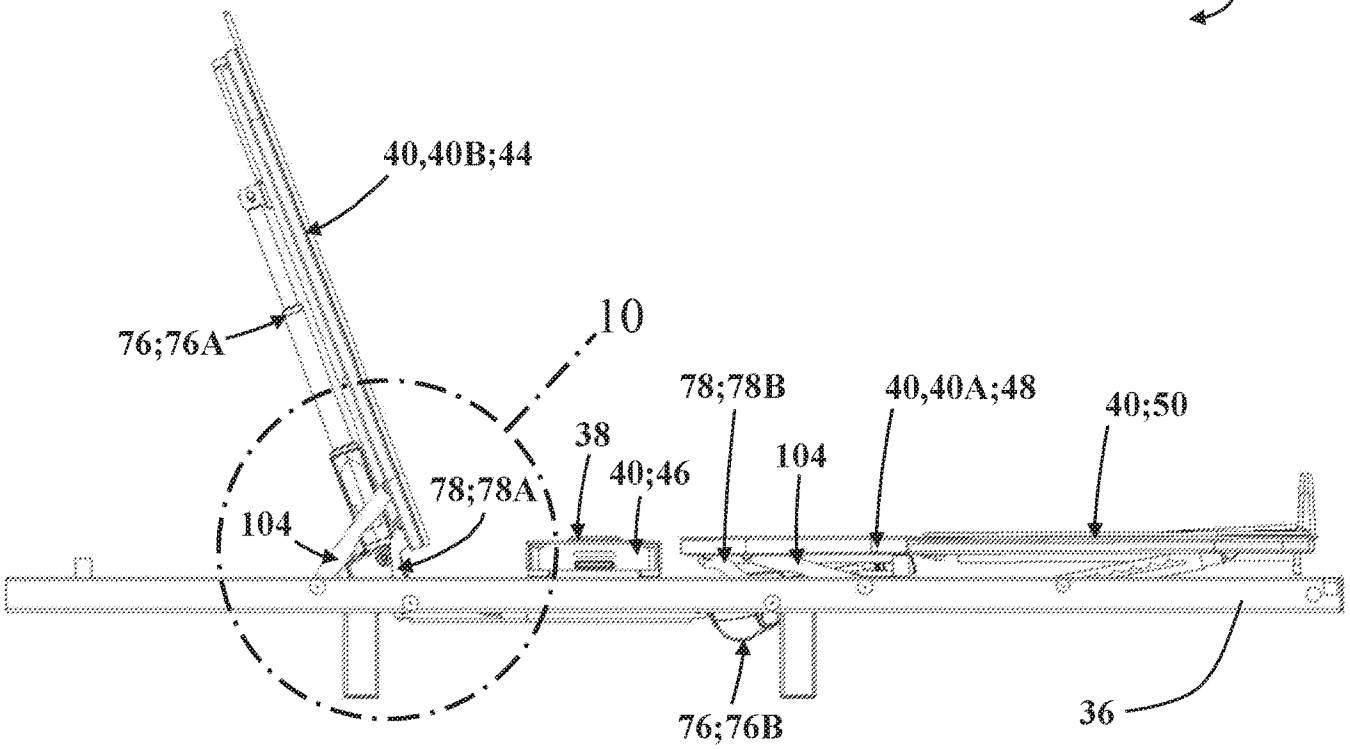
FIG. 6 is another side view of the support frame and the patient support deck of FIG. 5, showing the head deck section in a maximum raised configuration.
Figure 7:
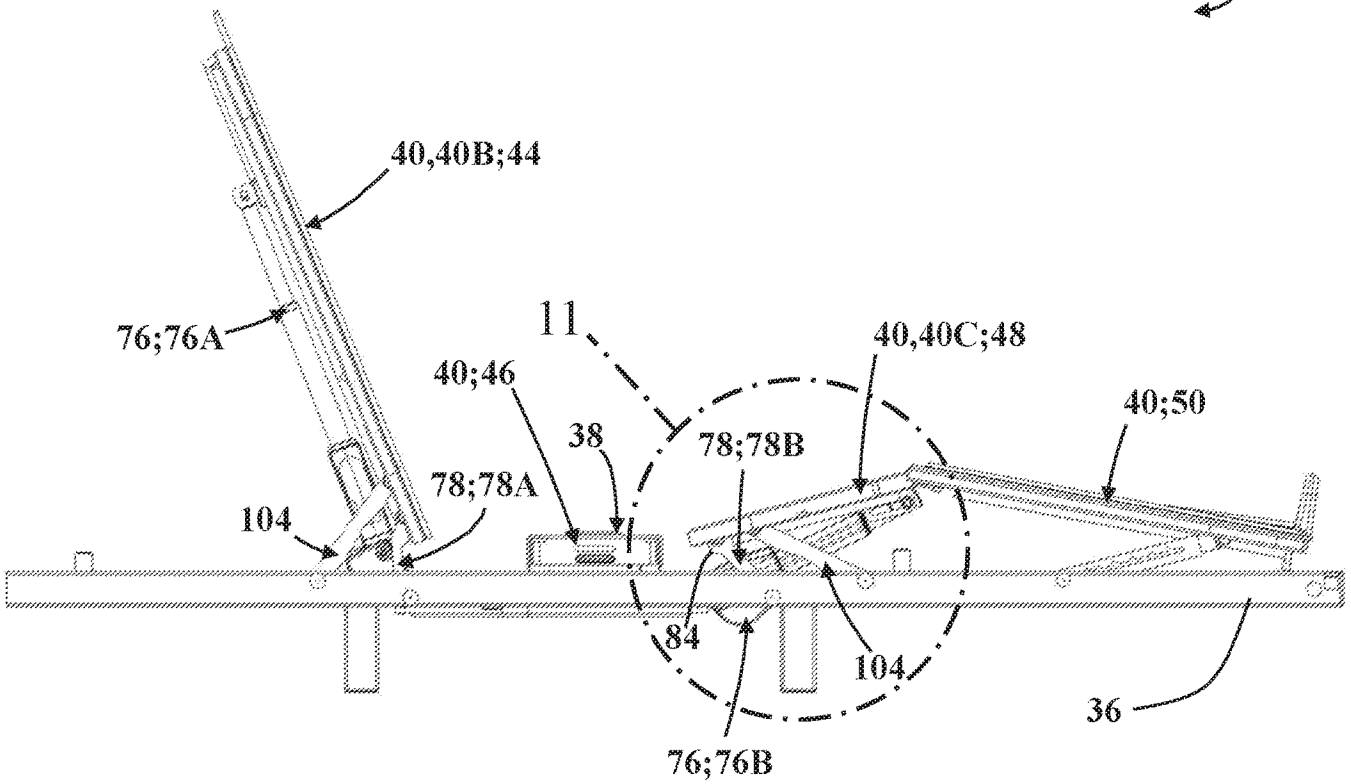
FIG. 7 is another side view of the support frame and the patient support deck of FIG. 6, showing the leg deck section in a first raised configuration.
Figure 8:
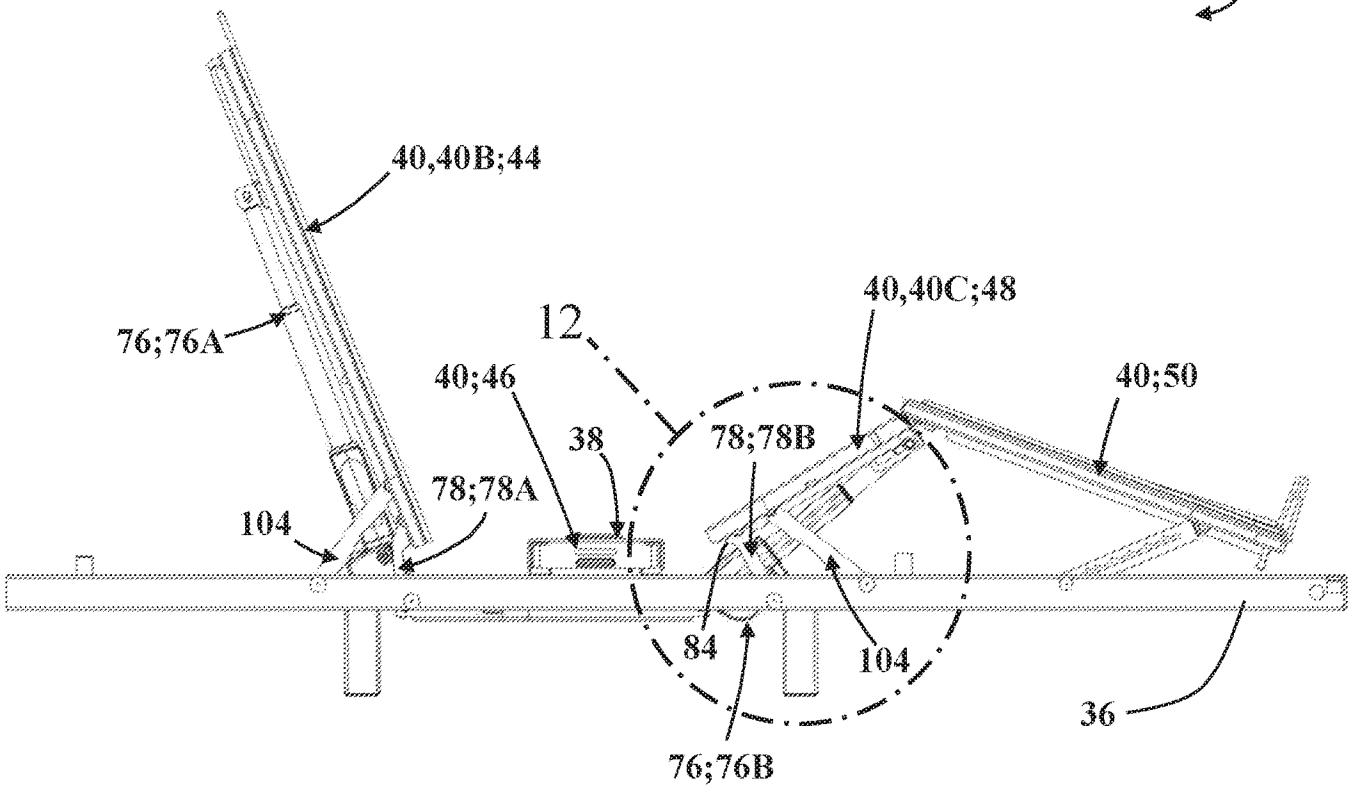
FIG. 8 is another side view of the support frame and the patient support deck of FIG. 7, showing the deck section in a maximum raised configuration.

In the representative embodiment illustrated herein, the actuator 76 is realized as a linear actuator disposed in force-translating relationship between the deck section 40 and the support frame 36. Here, as best shown in FIG. 3, the actuator 76 has an actuator base 86 and an actuator shaft 88 configured to extend from the actuator base 86 between different linear positions (not shown in detail). The actuator base 86 has a base pivot 90 configured to pivotally couple to a mount 92 operatively attached to the support frame 36, and the actuator shaft 88 has a shaft pivot 94 configured to pivotally couple to a slider 96 supported in a slotted bracket 98 operatively attached to the deck section 40. Here, movement of the actuator 76 between the linear positions is defined by the relative position of the shaft pivot 94 with respect to the base pivot 90. Those having ordinary skill in the art will appreciate that the actuator 76 could be of any suitable type or configuration sufficient to effect selective movement of the deck section 40 relative to the support structure 32. By way of non-limiting example, the actuator 76 could be a linear actuator or one or more rotary actuators driven electronically and/or hydraulically, and/or controlled or driven in any suitable way. Moreover the actuator 76 could be mounted, secured, coupled, or otherwise operatively attached to the support frame 36 and to the deck section 40, either directly or indirectly, in any suitable way.

In some embodiments, the actuator 76 is driven using a controller (not shown) to move or otherwise position the deck section 40 relative to the support frame 36. Here, the controller could be configured to prevent movement of the deck section 40 beyond a raised configuration 40C which is less than the maximum raised configuration 40B. This may be desirable to avoid harm to the patient that may otherwise occur if some portion of the patient is raised beyond the maximum raised configuration 40B. By way of non-limiting example, the controller could prevent movement of the deck section 40 beyond more than 60-degrees relative to the support frame 36. As an added preventive measure, abutment of the protruding stop 84 of the link 78 could prevent movement of the deck section 40 to beyond more than the maximum raised configuration 40B, such as 70-degrees relative to the support frame 36. To that end, the controller could rely upon one or more electronic sensors, such as limit switches or position sensors, as well as the flow of electrical current through the actuator 76, to limit movement. In such embodiments, it will be appreciated that the links 78 afford an increased level of protection by ensuring that the deck section 40 can not move to beyond the maximum raised configuration 40B, irrespective of the operation of the actuator 76, controller, and/or electronic sensors, which may fail in use or require adjustment over time.

The patient support apparatus 30 illustrated throughout the drawings has a first actuator 76A arranged to move the deck section 40 defined as the back section 44 relative to the support frame 36, and a second actuator 76B arranged to move the deck section 40 defined as the leg section 48 relative to the support frame 36. Here, the first actuator 76A and the second actuator 76B are similarly sized and may be controlled to move the back section 44 independently and selectively of the leg section 48. However, those having ordinary skill in the art will appreciate that a single actuator 76 could be employed to move one or more deck sections 40 concurrently with respect to the support frame 36. The foot section 50 is arranged to travel with and pivot with respect to the leg section 48, and is further arranged to pivot with respect to the support frame 36 to be angled relative to the leg section 48 (not shown in detail). However, as noted above, the deck section 40 could be configured in any suitable way, from any suitable number of discrete sections or components which move with respect to each other and/or the support frame 36 in any suitable way.

In the representative embodiment illustrated throughout the drawings, the link 78 supporting the deck section 40 defined as the back section 44 relative to the support structure 32 is further defined as a back link 78A, and the link 78 supporting the deck section 40 defined as the leg section 48 relative to the support structure 32 is further defined as a leg link 78B. Thus, FIGS. 4-6, 9, 10, 13, and 14 best illustrate the cooperation between the support frame 36, the first actuator 76A, and the back link 78A which effects movement of the deck section 40 defined as the back section 44 between the configurations 40A, 40B, 40C; and FIGS. 4, 7, 8, 11, 12, 15, and 16 best illustrate the cooperation between the support frame 36, the second actuator 76B, and the leg link 78B which effects movement of the deck section 40 defined as the leg section 48 between the configurations 40A, 40B, 40C.

With reference now to FIGS. 4-16, as noted above, the protruding stop 84 of the link 78 is arranged between the first end 80 and the second end 82 and engages the deck section 40 in the maximum raised configuration 40B. While the protruding stop 84 of the link 78 depicted throughout the drawings and described herein engages a portion of the deck section 40, it will be appreciated that the link 78 could also be configured such that the protruding stop 84 abuts a portion of the support frame 36. More specifically, it will be appreciated that the link 78 could be configured with one or more protruding stops 84 arranged to abut one or more portions of the deck section 40 and/or one or more portions of the support frame 36 when in the maximum raised configuration 40B.

In the representative embodiment illustrated herein, the protruding stop 84 which engages the deck section 40 in the maximum raised configuration 40B is arranged closer to one of the first end 80 and the second end 82 than to the other of the first end 80 and the second end 82. In one embodiment, the protruding stop 84 is formed integrally with the link 78 between the first end 80 and the second end 82. In the representative embodiment illustrated herein, the link 78 has a mirrored profile defined longitudinally between the first end 80 and the second end 82. Here, the link 78 has a first protruding stop 84A arranged adjacent to the first end 80 and a second protruding stop 84B arranged adjacent to the second end 82 with one of the protruding stops 84A, 84B abutting the deck section 40 in the maximum raised configuration 40B.

With specific reference now to FIGS. 9, 10, 13, and 14, the back links 78A cooperate to support the deck section 40 defined as the back section 44 for movement relative to the support frame 36, the as noted above. Here, the protruding stop 84 of the back links 78A each have a rounded profile arranged for abutment with a deck frame 116 of the deck section 40 defined as the back section 44 in the maximum raised configuration 40B (compare FIGS. 9 and 10). Here, the back links 78A have a generally C-shaped profile between the first end 80 and the second end 82 and have a mirrored profile with a pair of protruding stops 84A, 84B, as noted above (see FIG. 14). It will be appreciated that this mirrored configuration allows the back links 78A to be installed in two different orientations.

With specific reference now to FIGS. 11, 12, 15, and 16, the leg links 78B cooperate to interconnect the deck section 40 defined as the leg section 48 and the support frame 36 to enable movement of the deck section 40 relative to the support frame 36, as noted above. Here, the protruding stops 84 of the leg links 78B each have a notched profile arranged for engagement with the deck frame 116 of the deck section 40 defined as the leg section 48 in the maximum raised configuration 40B (compare FIGS. 11 and 12). Here, the leg links 78B have a generally I-shaped profile between the first end 80 and the second end 92. Here too, the leg links 78B have a mirrored profile defined longitudinally, and also have a symmetric profile between the first end 80 and the second end 82. Thus, in this embodiment, the leg links 78B each have a pair of opposing first protruding stops 84A arranged adjacent to the first end 80 and a pair of opposing second protruding stops 84B arranged adjacent to the second end 82, with one of the four protruding stops 84 abutting the deck section 40 defined as the leg section 48 in the maximum raised configuration 40B (see FIG. 16). It will be appreciated that this mirrored, symmetric configuration allows the leg links 78B to be installed in four different orientations, thereby contributing to ease of assembly of the patient support apparatus 30.

Those having ordinary skill in the art will appreciate that the back links 78A are arranged, sized, shaped, and configured differently from the leg links 78B in the representative embodiment illustrated herein so as to facilitate correspondingly different movement of the back section 44 and the leg section 48, respectively, relative to the support frame 36. Similarly, the back section 44 is arranged, sized, shaped, and configured differently from the leg section 48. Nevertheless, those having ordinary skill in the art will appreciate that the back links 78A could be arranged, sized, shaped, and/or configured similarly to the leg links 78B for certain applications. Moreover, while the patient support apparatus 30 is shown with a pair of back links 78A and a pair of leg links 78B, it will be appreciated that any suitable number of back links 78A and/or leg links 78 could be utilized. For the purposes of clarity and consistency, subsequent description of the deck section 40 applies to both the back section 44 and the leg section 48 unless otherwise indicated. Similarly, subsequent description of the link 78 applies to both the back link 78A and the leg link 78B unless otherwise indicated.

Figure 9:
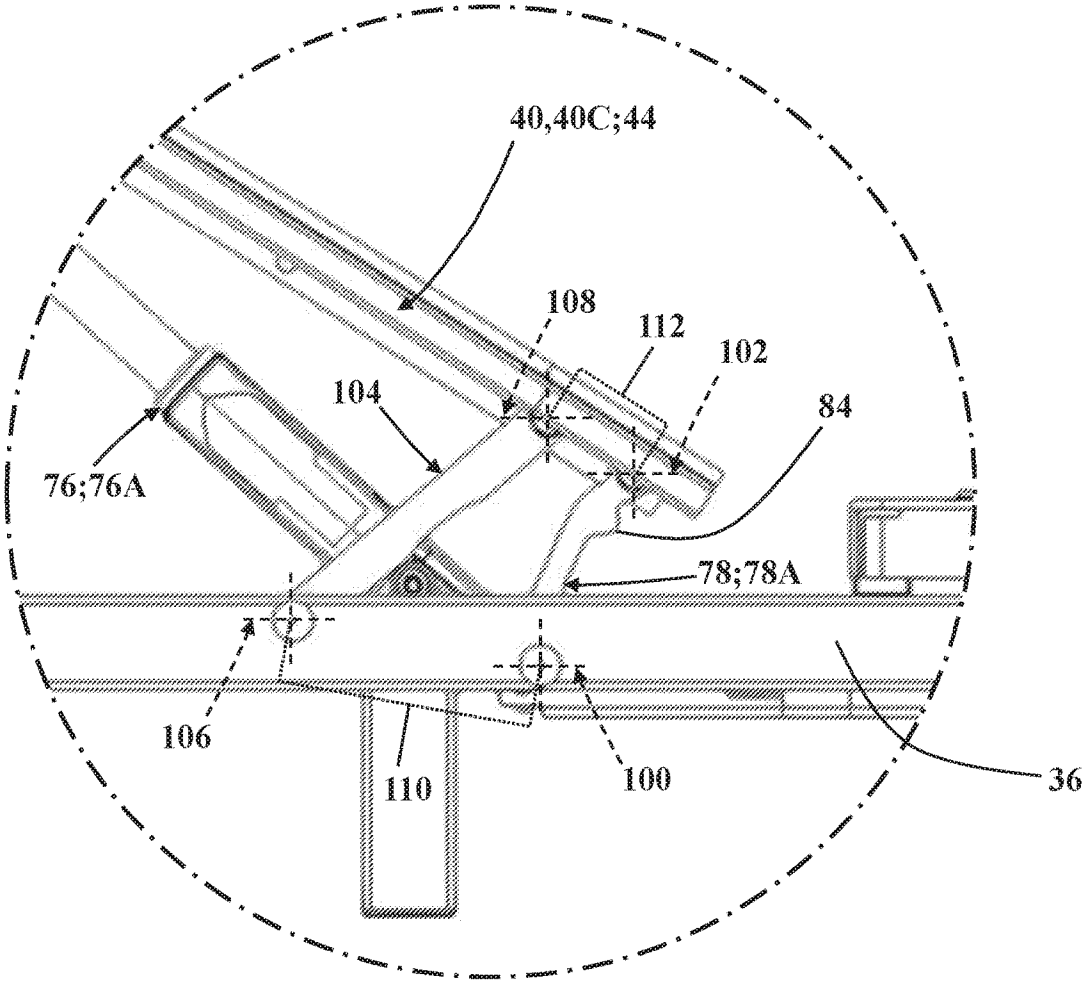
FIG. 9 is an enlarged partial side view taken from indicia 9 of FIG. 5, showing additional detail of the links supporting the head deck section with respect to the support frame.
Figure 10:
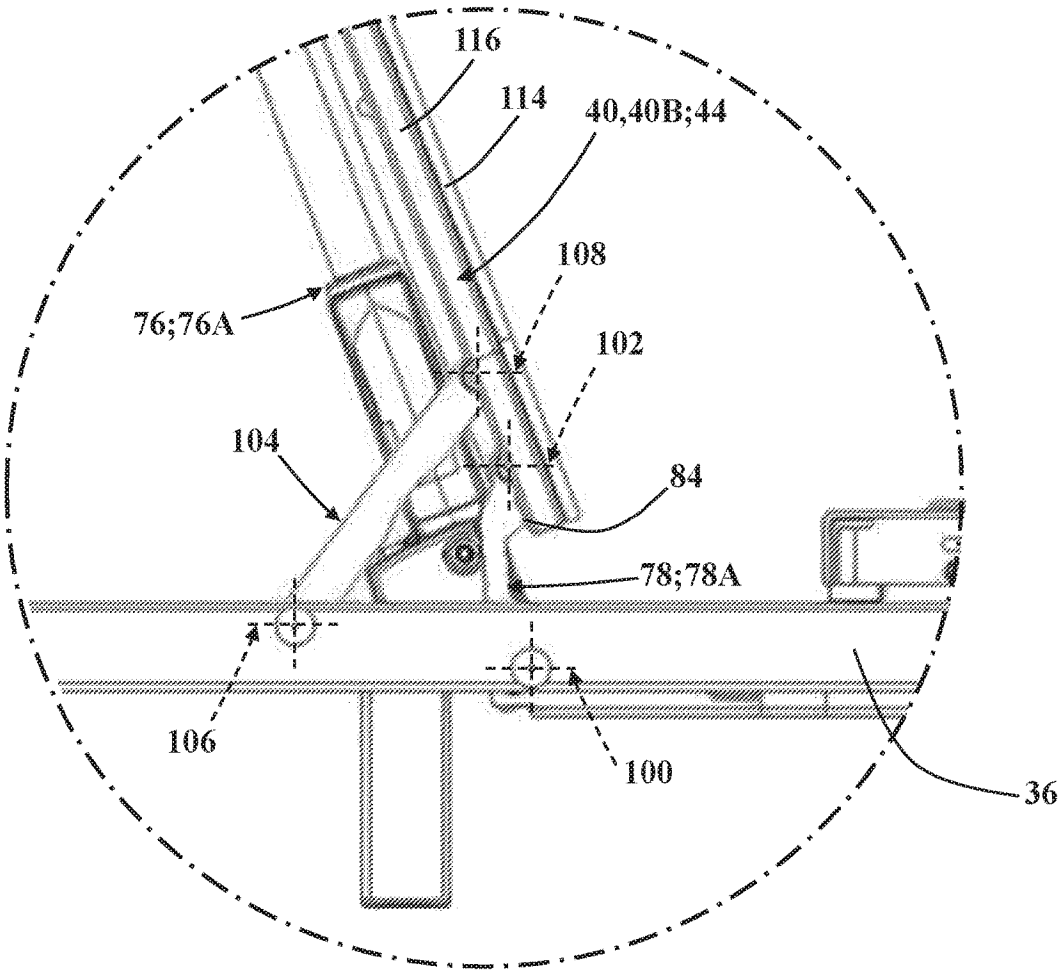
FIG. 10 is an enlarged partial side view taken from indicia 10 of FIG. 6, showing additional detail of the links supporting the head deck section with respect to the support frame.
Figure 11:
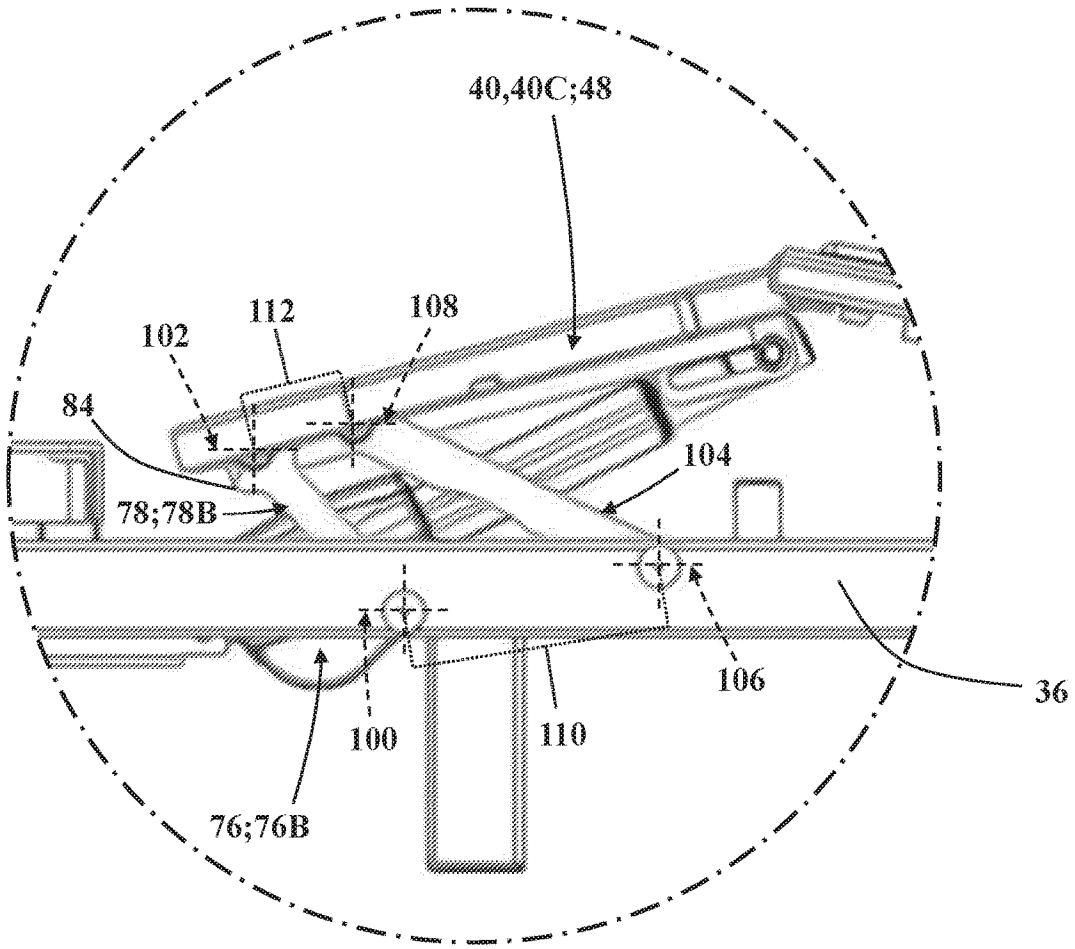
FIG. 11 is an enlarged partial side view taken from indicia 11 of FIG. 7, showing additional detail of the links supporting the leg deck section with respect to the support frame.
Figure 12:
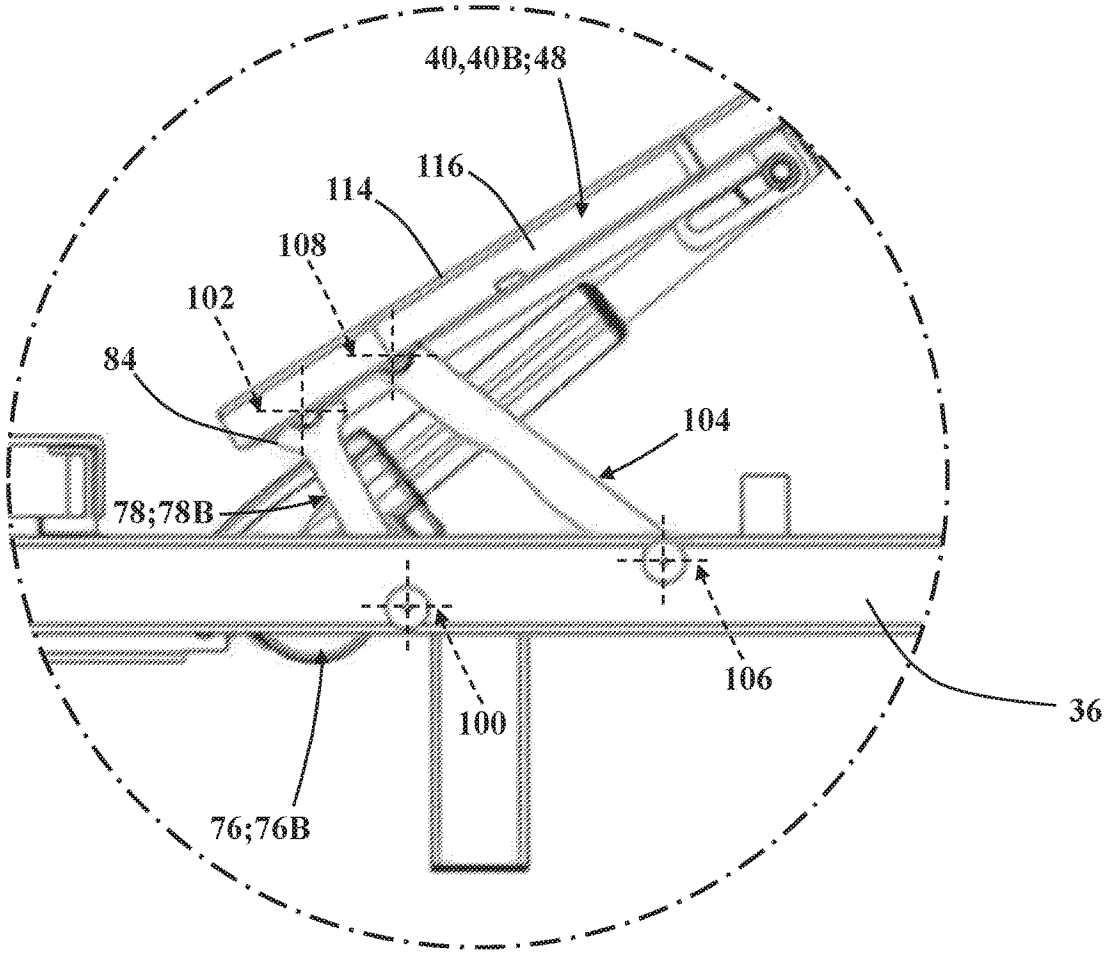
FIG. 12 is an enlarged partial side view taken from indicia 12 of FIG. 8, showing additional detail of the links supporting the leg deck section with respect to the support frame.

Referring now to FIGS. 9-12, the link 78 is pivotally attached to the support frame 36 about a first frame axis 100 and is pivotally attached to the deck section 40 about a first deck axis 102. In one embodiment, the patient support apparatus 30 further comprises a bar 104 pivotally attached to the support frame 36 about a second frame axis 106 and pivotally attached to the deck section 40 about a second deck axis 108. In the representative embodiment illustrated herein, a pair of links 78 and a pair of bars 104 cooperate to support the deck section 40. Here, each of the links 78 are pivotally attached to the support frame 36 about the first frame axis 100 and to the deck section 40 about the first deck axis 102, and each of the bars 104 are pivotally attached to the support frame 36 about the second frame axis 106 and to the deck section 40 about the second deck axis 108. As is shown in FIGS. 9 and 11, the first frame axis 100 is spaced from the second frame axis 106 at a frame axis distance 110, and the first deck axis 102 is spaced from the second deck axis 108 at a deck axis distance 112. The frame axis distance 110 is greater than the deck axis distance 112. It will be appreciated that this configuration promotes smooth articulation of the deck section 40 relative to the support frame 36.

In this embodiment, one of the links 78, one of the bars 104, the support frame 36, and the deck section 40 form a four-bar linkage arrangement to constrain articulation of the deck section 40 relative to the support frame 36. The other of the links 78, the other of the bars 104, the support frame 36, and the deck section 40 form another four-bar linkage. Thus, two four-bar linkages are present to constrain articulation of the deck section 40 relative to the support frame 36. Accordingly, the pair of links 78 and the pair of bars 104 cooperate to constrain movement of the deck section 40 relative to the support frame 36 upon operation of the actuator 76. Effectively, the pair of links 78 and the pair of bars 104 constrain movement of the deck section 40 such that an end of the deck section 40 adjacent the links 78 moves longitudinally relative to an adjacent deck section during raising/lowering. It will be appreciated that any suitable number of links 78 and/or bars 104 could be employed. It will also be appreciated that other arrangements of the links 78 and/or bars 104 could be employed, or that only a single link 78 and/or single bar 104 could be employed. In one embodiment, the link 78 and the bar 104 are manufactured from steel, such as from stamped sheet steel. However, it will be appreciated that the link 78 and/or the bar 104, as well as any other portion of the patient support apparatus 30, could be manufactured from any suitable material, in any suitable way, and by using any suitable process. By way of non-limiting example, the bar 104 could be manufactured from aluminum using a casting process.

Figure 13:
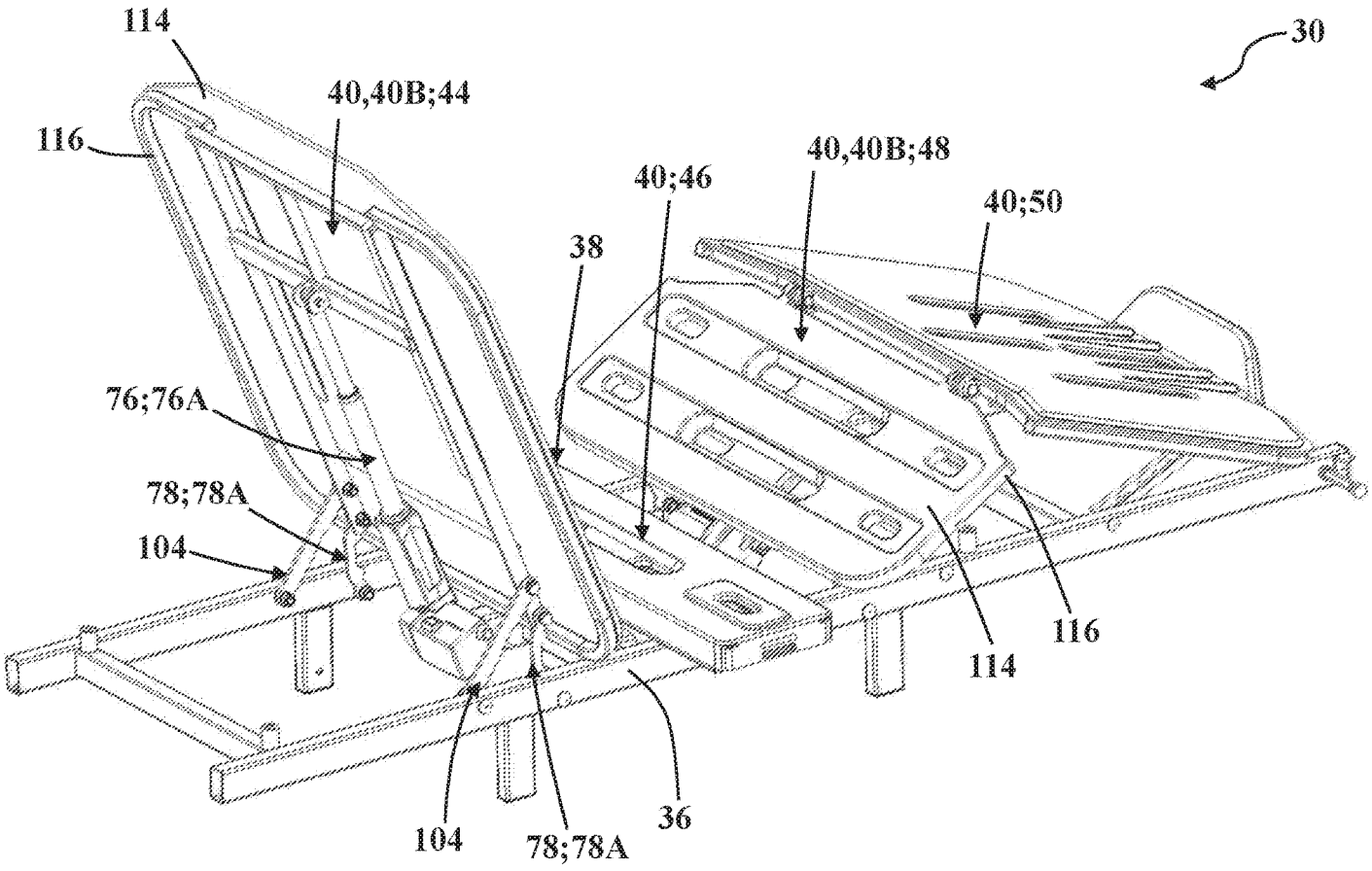
FIG. 13 is a perspective view of the support frame and the patient support deck with the head deck section shown in the maximum raised configuration as depicted in FIGS. 6 and 8.
Figure 14:
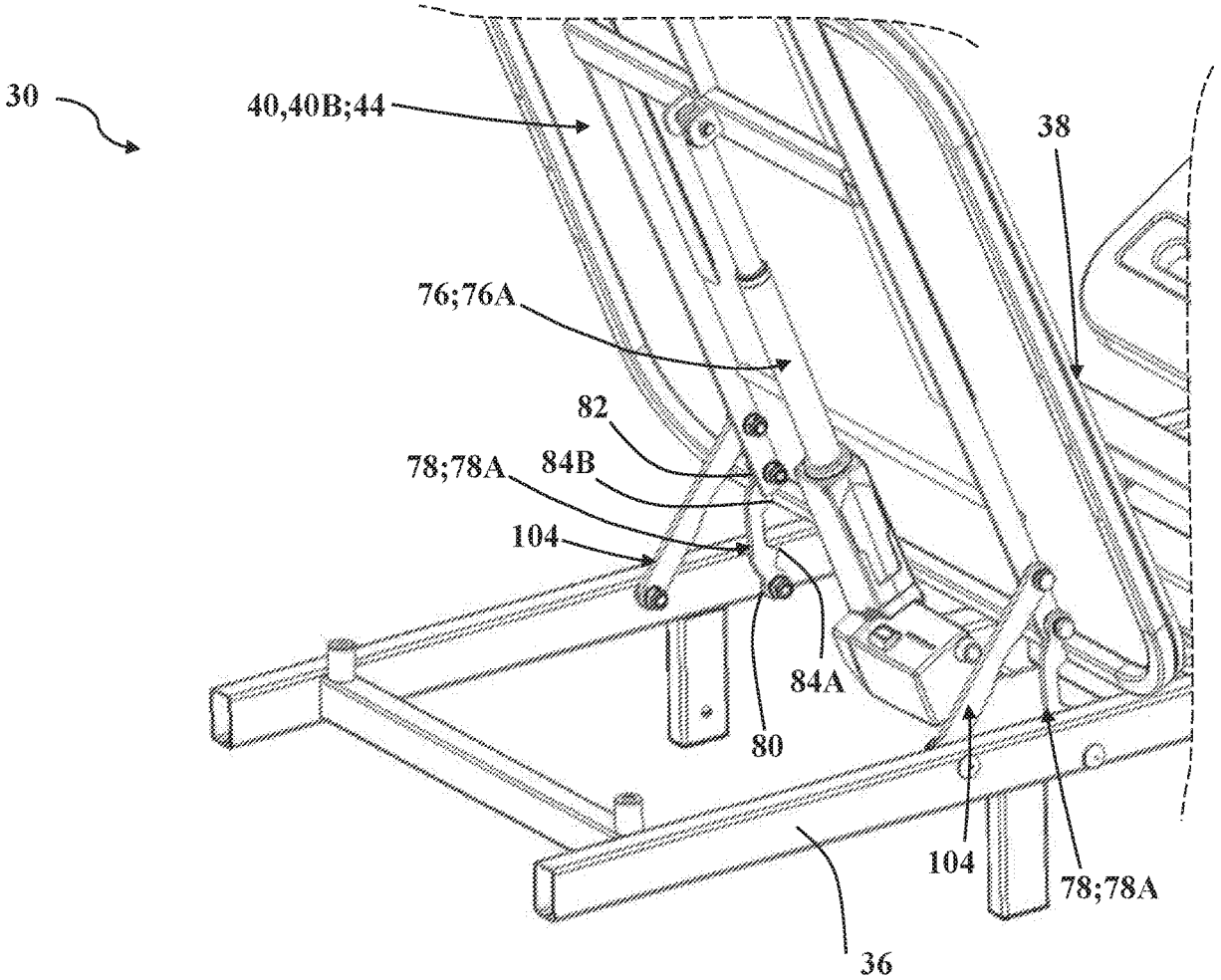
FIG. 14 is an enlarged partial perspective view of the support frame and the patient support deck of FIG. 13, showing additional detail of the links supporting the head deck section in the maximum raised configuration.
Figure 15:
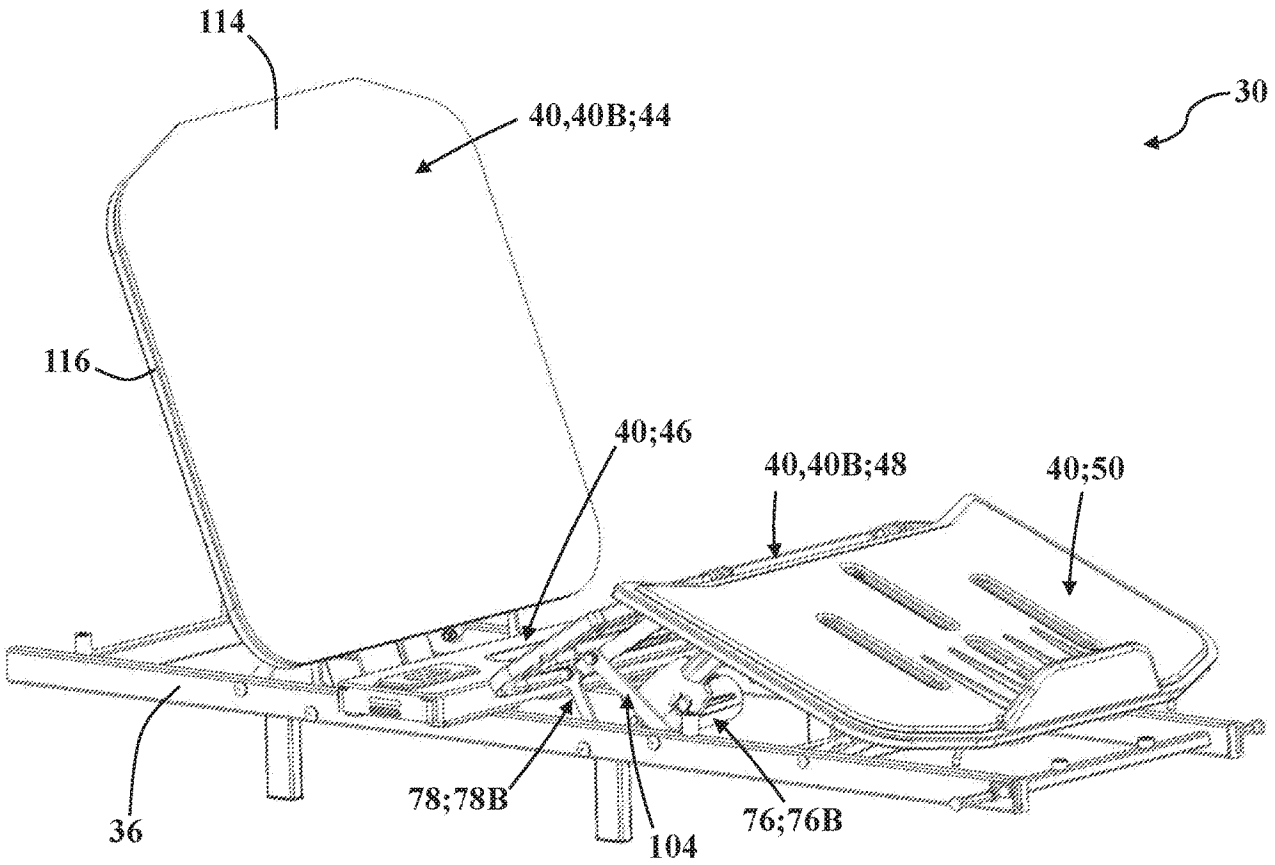
FIG. 15 is a perspective view of the support frame and the patient support deck with the leg deck section shown in the maximum raised configuration as depicted in FIGS. 8 and 13.
Figure 16:
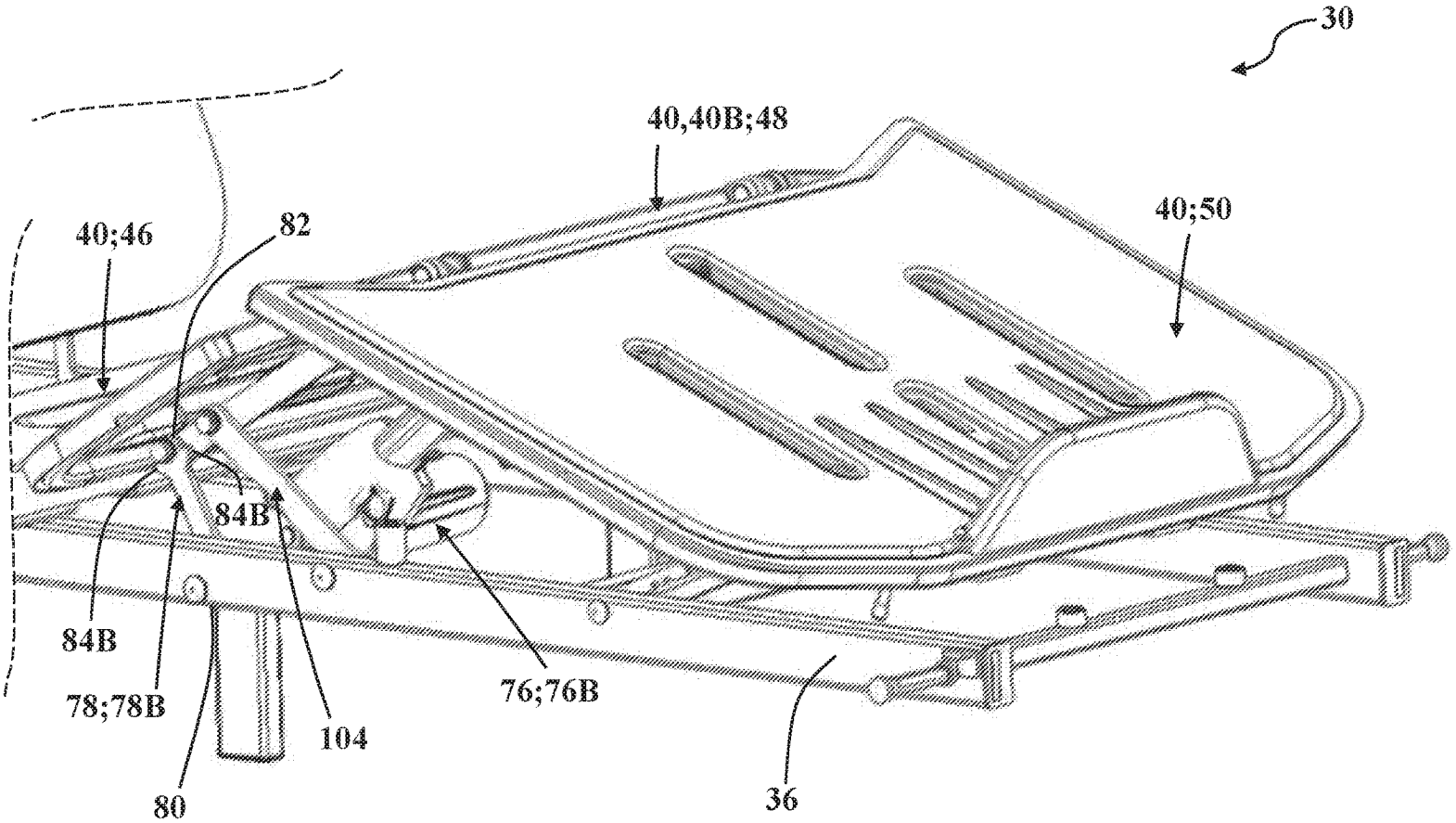
FIG. 16 is an enlarged partial perspective view of the support frame and the patient support deck of FIG. 15, showing additional detail of the links supporting the leg deck section in the maximum raised configuration.

As is best shown in FIGS. 3 and 13, in one embodiment, the deck section 40 comprises a deck platform 114 and the deck frame 116. The deck frame 116 supports the deck platform 114 for concurrent movement between the configurations 40A, 40B, 40C, with the protruding stops 84 of the links 78 abutting the deck frame 116 when the deck section 40 is in the maximum raised configuration 40B (see also FIGS. 10 and 12). Here, the deck platform 114 of the deck section 40 has a generally planar configuration and defines a portion of the patient support surface 42, as noted above. As best shown in FIG. 2, the deck platform 114 may have a congruent, generally flat configuration or may have a profiled configuration with one or more holes, slots, and/or apertures formed therethrough. As best shown in FIG. 3, the slotted bracket 98 is operatively attached to the deck frame 116 of the deck section 40, and the deck frame 116 is formed from elongated, generally-rectangular bars or tubes operatively attached to each other which are shaped and arranged so as to compliment the configuration and profile of the deck platform 114. However, those having ordinary skill in the art will appreciate that the deck section 40 could have any suitable shape or profile, formed from any suitable number of components operatively attached together for concurrent movement in any suitable way. By way of non-limiting example, the deck section 40 could be formed as a unitary, one-piece component.

In this way, abutment of the protruding stops 84 of the links 78 with the deck frame 116 of the deck section 40 in the maximum raised configuration 40B ensures that the actuator 76 can not move the deck section 40 to beyond the maximum raised configuration 40B. Thus, it will be appreciated that the physical stops afforded by the arrangement of the links 78 allows for advantageous implementation of actuators 76 which are smaller than and/or less expensive than similar actuators with integrated stops, electronic sensors, and the like. Further, it will be appreciated that the links 78 provided with the protruding stops 84 can be implemented in a simple, cost-effective way. Moreover, because the links 78 allow the patient support apparatus 30 to omit external limit switches and/or electronic sensors, such as linear potentiometers, the cost and complexity of manufacturing, using, and servicing the patient support apparatus 30 is reduced further while, at the same time, ensuring that the deck section 40 can move between the configurations 40A, 40B, 40C without exceeding the maximum raised configuration 40B. Similarly, the links 78 allow for an increased level of protection when used in connection with patient support apparatuses which do rely on a controller and/or sensors to limit movement to one or more raised configurations 40C by ensuring that the deck section 40 can not move beyond the maximum raised configuration 40B, irrespective of the performance of the controller and/or sensors over time.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a support frame;

a patient support deck operatively attached to said support frame and having at least one deck section arranged for movement relative to said support frame;

an actuator arranged to move said at least one deck section between an initial configuration and one or more raised configurations relative to said support frame; and a link supporting said at least one deck section for movement with respect to said support frame, said link having a first end pivotally attached to said support frame, a second end pivotally attached to said at least one deck section, and a protruding stop formed between said first end and said second end arranged to abut said at least one deck section so as to prevent said actuator from moving said at least one deck section beyond a maximum raised configuration.

2. The patent support apparatus as set forth in claim 1, wherein said actuator is a linear actuator disposed in force-translating relationship between said at least one deck section and said support frame.

3. The patient support apparatus as set forth in claim 1, wherein said link is pivotally attached to said support frame about a first frame axis and pivotally attached to said at least one deck section about a first deck axis.

4. The patient support apparatus as set forth in claim 3, comprising a pair of links pivotally attached to said support frame about said first frame axis and pivotally attached to said at least one deck section about said first deck axis.

5. The patient support apparatus as set forth in claim 3, further comprising a bar pivotally attached to said support frame about a second frame axis and pivotally attached to said at least one deck section about a second deck axis.

6. The patient support apparatus as set forth in claim 5, wherein said first frame axis is spaced from said second frame axis at a frame axis distance, said first deck axis is spaced from said second deck axis at a deck axis distance, and said frame axis distance is greater than said deck axis distance.

7. The patient support apparatus as set forth in claim 5, comprising a pair of bars pivotally attached to said support frame about said second frame axis and pivotally attached to said at least one deck section about said second deck axis.

8. The patient support apparatus as set forth in claim 1, wherein said at least one deck section comprises a deck platform and a deck frame supporting said deck platform for concurrent movement between said configurations with said protruding stop of said link abutting said deck frame when said at least one deck section is in said maximum raised configuration.

9. The patient support apparatus as set forth in claim 1, wherein said protruding stop of said link is arranged closer to one of said first end and said second end than to the other of said first end and said second end.

10. The patient support apparatus as set forth in claim 1, wherein said protruding stop of said link has a rounded profile arranged for abutment with said deck section in said maximum raised configuration.

11. The patient support apparatus as set forth in claim 1, wherein said protruding stop of said link has a notched profile arranged for engagement with said deck section in said maximum raised configuration.

12. The patient support apparatus as set forth in claim 1, wherein said at least one deck section is further defined as a back section.

13. The patient support apparatus as set forth in claim 1, wherein said at least one deck section is further defined as a leg section.

14. The patient support apparatus as set forth in claim 1, wherein said protruding stop is formed integrally with said link between said first end and said second end.

15. The patient support apparatus as set forth in claim 1, wherein said link has a mirrored profile defined longitudinally between said first end and said second end.

16. The patient support apparatus as set forth in claim 15, wherein said link has a first protruding stop arranged adjacent to said first end and a second protruding stop arranged adjacent to said second end with one of said protruding stops abutting said at least one deck section in said maximum raised configuration.

17. The patient support apparatus as set forth in claim 15, wherein said link has a symmetric profile between said first end and said second end.

18. The patient support apparatus as set forth in claim 17, wherein said link has a first pair of opposing protruding stops arranged adjacent to said first end and a second pair of opposing protruding stops arranged adjacent to said second end with one of said protruding stops abutting said at least one deck section in said maximum raised configuration.

19. The patient support apparatus as set forth in claim 1, wherein said link has a generally C-shaped profile between said first end and said second end.

20. The patient support apparatus as set forth in claim 1, wherein said link has a generally I-shaped profile between said first end and said second end.

21. A patient support apparatus comprising:

a support frame;

a patient support deck operatively attached to said support frame and having at least one deck section arranged for movement relative to said support frame;

an actuator arranged to move said deck section between an initial configuration and one or more raised configurations relative to said support frame; and a plurality of links supporting said deck section for movement with respect to said support frame, each of said links having a first end pivotally attached to said support frame and a second end pivotally attached to said deck section, with at least one of said links having a stop formed between said first end and said second end arranged to abut said deck section so as to prevent said actuator from moving said deck section beyond a maximum raised configuration.

22. A patient support apparatus comprising:

a support frame;

a patient support deck operatively attached to said support frame and having a back section arranged for movement relative to said support frame and a leg section arranged for movement relative to said support frame;

a first actuator arranged to move said back section between an initial configuration and one or more raised configurations relative to said support frame;

a second actuator arranged to move said leg section between an initial configuration and one or more raised configurations relative to said support frame;

a back link supporting said back section for movement with respect to said support frame, said back link having a first end pivotally attached to said support frame, a second end pivotally attached to said back section, and a protruding stop formed between said first end and said second end arranged to abut said back section so as to prevent said first actuator from moving said back section beyond a maximum raised configuration; and a leg link supporting said leg section for movement with respect to said support frame, said leg link having a first end pivotally attached to said support frame, a second end pivotally attached to said leg section, and a protruding stop formed between said first end and said second end arranged to abut said leg section so as to prevent said second actuator from moving said leg section beyond a maximum raised configuration.

* * * * *